US005908479A

United States Patent [19]

Wampole

[11] Patent Number: 5,908,479

[45] Date of Patent: Jun. 1, 1999

[54] FILTER DEVICE TO REDUCE CIGARETTE SMOKE

[76] Inventor: Brian Wampole, 1847 Lesher Mill Rd., Palm, Pa. 18070

[21] Appl. No.: 09/038,831

[22] Filed: Mar. 12, 1998

[51] Int. Cl.[6] ..... B01D 46/44; A24F 19/10

[52] U.S. Cl. ..... 55/385.1; 55/385.8; 131/175

[58] Field of Search ..... 55/385.8, 385.1; 131/175, 200, 212.1, 215.1

[56] References Cited

U.S. PATENT DOCUMENTS

| | | | |
|---|---|---|---|
| 3,946,748 | 3/1976 | Frankfurt | 55/385.1 |
| 4,623,367 | 11/1986 | Paulson | 55/385.8 |
| 4,790,332 | 12/1988 | Wallace | 131/175 |
| 4,899,766 | 2/1990 | Ross, Jr. | 131/175 |
| 5,088,508 | 2/1992 | Duncan | 55/385.8 |
| 5,160,518 | 11/1992 | Vega, Jr. | 55/385.8 |

*Primary Examiner*—Jay H. Woo
*Assistant Examiner*—Minh-Chau T. Pham
*Attorney, Agent, or Firm*—Zachary T. Wobensmith, III

[57] ABSTRACT

A filter device for use when smoking cigarettes, which safely carries a lit cigarette therein, allows the smoker to inhale smoke from the cigarette and then either to exhale the smoke into the air or back into the device, which captures the smoke and prevents it from escape into the air.

3 Claims, 1 Drawing Sheet

FILTER DEVICE TO REDUCE CIGARETTE SMOKE

BACKGROUND OF THE INVENTION

1. Field of the Invention

This invention relates to a filter device to reduce cigarette smoke, of the type which carries a lit cigarette therein, from which smoke may be inhaled, and then exhaled back into the device for containment.

2. Description of the Prior Art

There is considerable interest in reducing second hand cigarette smoke, i.e., the smoke exhaled by smokers into the air and to which others are exposed.

There is also interest by smokers in continuing to smoke, and to do so at any time and any location without impinging on the rights of others, and with improved protection from injury to the smoker and his surroundings from exposure to lit cigarettes.

Filters have been proposed which encapsulate a cigarette and purport to filter primary and second hand smoke, such as shown in U.S. Pat. No. 5,472,001, but such devices are bulky, complicated, expensive and impractible for mass production.

The filter device of the invention does not suffer from the problems of the prior art devices and provides positive advantages.

SUMMARY OF THE INVENTION

It has now been found that a filter device to reduce cigarette smoke is available which is of cylindrical configuration and which includes a first chamber adapted to hold a cigarette, a solid end cap closing off one end of the device, and a front end cap closing off the front end of the device, with the cigarette therein, an inner layer of air permeable expanded metal defining the outside of the first chamber, an inner cylinder of micro fiber filter material outside of said inner metal layer, a first intermediate layer of air permeable expanded metal defining the inside of a second chamber, a second intermediate layer of air permeable expanded metal, with the first intermediate layer defining the outer limits of the second chamber, openings in the front end cap in communication with the second chamber, an outer cylinder of micro fiber filter media outside the second intermediate metal layer, a cylinder of air permeable plastic fibers outside said outer cylinder and an outer air permeable layer of expanded metal.

The principal object of the invention is to provide a filter device to reduce cigarette smoke, which carries the lit cigarette therein, and contains both primary and secondary smoke.

A further object of the invention is to provide a filter device that is simple and inexpensive to manufacture.

A further object of the invention is to provide a filter device that is easy to use.

A further object of the invention is to provide a filter device that protects the user from accidental burns.

A further object of the invention is to provide a filter device that lends itself to mass production.

Other objects and advantageous features of the invention will be apparent from the description and claims.

DESCRIPTION OF THE DRAWINGS

The nature and characteristic features of the invention will be more readily understood from the following description taken in connection with the accompanying drawings forming part hereof in which.

It should, of course, be understood that the description and drawings herein are merely illustrative, and that various modifications and changes can be made in the structure disclosed without departing from the spirit of the invention.

Like numerals refer to like parts throughout the several views.

DESCRIPTION OF THE PREFERRED EMBODIMENT

When referring to the preferred embodiment, certain terminology will be utilized for the sake of clarity. Use of such terminology is intended to encompass not only the described embodiment, but also technical equivalents which operate and function in substantially the same way to bring about the same result.

Figure 1:
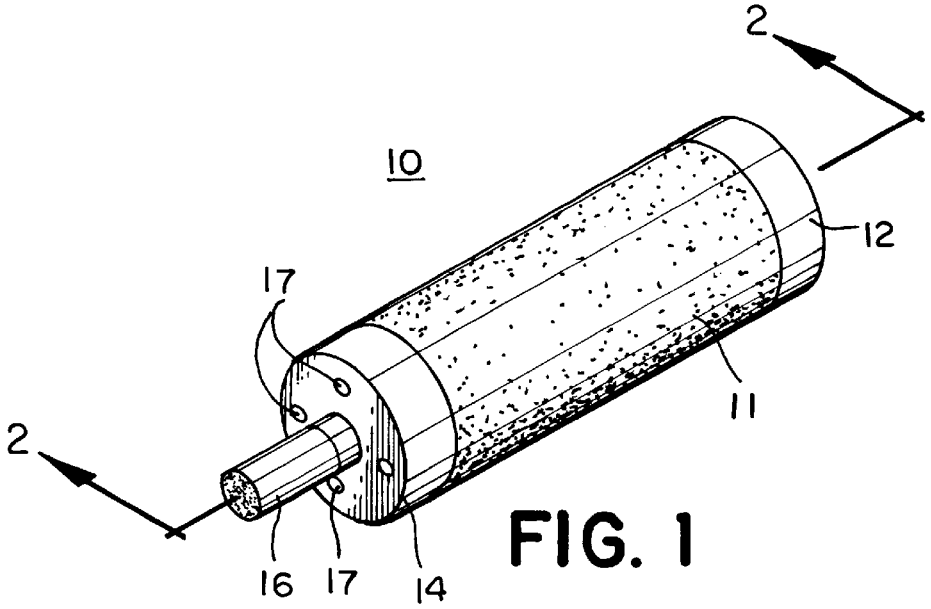
FIG. 1 is a perspective view of the filter device of the invention.
Figure 2:
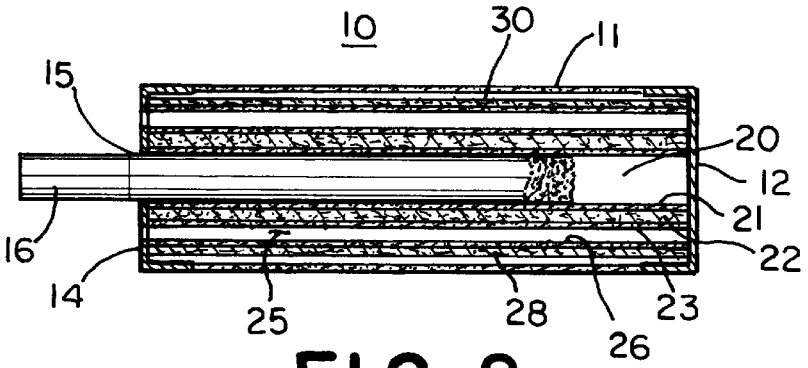
FIG. 2 is a vertical sectional view taken approximately on the line 2—2 of FIG. 1.
Figure 3:
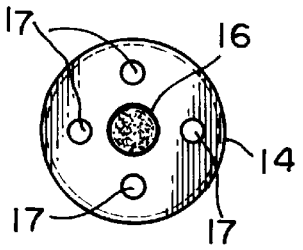
FIG. 3 is a front view of the filter device.

Referring now more particularly to FIGS. 1, 2 and 3, the filter device 10 is therein illustrated.

The device 10 is of cylindrical construction with a plurality of layers to be described. An outer metal layer 11 is provided which is of an air permeable 24 gauge expanded aluminum metal of well known type.

The device is closed off at the rear end by a solid plastic cap 12, which is secured to the outer metal layer 11 in well known manner such as by heat or adhesive of well known type.

The device 10 is closed off at its front end by a plastic cap 14 which is secured to the outer metal layer 11 in well known manner such as by heat or adhesive of well known type.

The cap 14 has a central opening 15 which is adapted to hold a cigarette 16, with slight compression to form air tight seal, and a plurality of spaced openings 17 are provided, four being illustrated which communicate with the interior of the device 10 to be described.

A first chamber 20 is provided to surround cigarette 16 whose boundary is defined by an inner layer 21 of air permeable expanded metal, an inner cylinder 22 of a smoke absorbing multi-layer micro filter media, outside of inner metal layer 21 which material is available as AFS-2 from Schuller International, P.O. Box 158, Rochester, N.Y. A first intermediate layer 23 of air permeable expanded metal is provided outside of cylinder 22 defining the inner boundary of a second chamber 25, and a second intermediate layer 26 of air permeable expanded metal is provided defining the outer boundary of second chamber 25. A second cylinder 28 is provided outside layer 26 of a multi-layer smoke absorbing micro filter media similar to cylinder 22.

A cylinder 30 of an air permeable multi-layer material is provided outside cylinder 28, illustrated as of four layers and composed of a mix of spun polyester and polypropylene fibers of four ounce weight, which serves as a drain layer and is engaged with the outer metal layer 11.

To use the device 10, the smoker lights a cigarette 16 and inserts it into the first chamber 20 through opening 15 in cap 14.

The smoker (not shown) can carry the device around without any smoke escaping due to the action of the smoke absorbing filter media inner cylinder 22 which contains the smoke.

The smoker can put the cigarette to his or her lips and inhale primary smoke into the lungs. If desired, the smoker can then exhale the smoke (secondary smoke) into the atmosphere.

If the smoker decides not to expose others to secondary smoke or to eliminate the secondary smoke, the cap 14 is placed in the smoker's mouth and the inhaled smoke blown back through openings 17 into the second chamber 25 of the device 10 where the filter media of outer cylinder 28 absorbs the smoke particles and hot air can be exhausted through layers 21, 23, 26, and 11 to the atmosphere.

The activities described can continue as desired without the escape of smoke to the atmosphere.

I claim:

1. A filter device of cylindrical configuration to reduce the emission of cigarette smoke from a lit cigarette carried therein which comprises a first chamber to contain said cigarette, an inner layer of air permeable expanded metal forming the outer boundary of said chamber, a first cylinder of smoke absorbing filter media surrounding said first chamber, a first intermediate layer of air permeable expanded metal outside of said first filter media, a second intermediate layer of air permeable expanded metal spaced from said first intermediate layer, a second chamber formed by said first and second intermediate layers, a second cylinder of smoke absorbing filter media surrounding said second intermediate layer, a cylinder of air permeable plastic fibers outside of said second cylinder, an outer layer of air permeable expanded metal outside of said plastic fibers, a solid cap to close off the rear end of the device, a cap to close off the front end of the device, said front end cap having a central opening to receive said cigarette, and a plurality of openings spaced in said front end cap in communication with said second chamber.

2. A filter device as defined in claim 1 in which said layers of expanded metal are of aluminum metal.

3. A filter device as defined in claim 1 in which said plastic cylinder is of multi-layers of spun polyester, and polypropylene fibers.

* * * * *